United States Patent [19]

Capizzi et al.

[11] Patent Number: 4,709,340

[45] Date of Patent: Nov. 24, 1987

[54] DIGITAL SPEECH SYNTHESIZER

[75] Inventors: Giuseppe N. Capizzi, Brandizzo; Cesario Cianci, Pianezza; Marcello Melgara, Valenza, all of Italy

[73] Assignee: CSELT—Centro Studi e Laboratori Telecomunicazioni S.p.A., Turin, Italy

[21] Appl. No.: 619,029

[22] Filed: Jun. 11, 1984

[30] Foreign Application Priority Data

Jun. 10, 1983 [IT] Italy ..... 67642 A/83

[51] Int. Cl.[4] ..... G10L 5/00

[52] U.S. Cl. ..... 364/513.5; 381/51

[58] Field of Search ..... 381/51-63; 364/513.5

[56] References Cited

U.S. PATENT DOCUMENTS

| | | | |
|---|---|---|---|
| 4,389,537 | 6/1983 | Tsunoda et al. | 381/51 |
| 4,412,099 | 10/1983 | Niyada et al. | 381/51 |
| 4,419,540 | 12/1983 | Henderson | 381/51 |
| 4,519,027 | 5/1985 | Vogelsberg | 381/51 |
| 4,581,757 | 4/1986 | Cox | 381/51 |

*Primary Examiner*—E. S. Matt Kemeny

*Attorney, Agent, or Firm*—Karl F. Ross; Herbert Dubno

[57] ABSTRACT

Speech synthesis is selectable in two modes: "normal" mode in which the synthesis filter is responsive to prestored parameters, and "test" mode which executes a checking procedure based on test words from an outside source. Each mode has corresponding instructions prestored in a memory.

15 Claims, 3 Drawing Figures

| | | | | | | | |
|---|---|---|---|---|---|---|---|
| $D_7$ | $D_6$ | $D_5$ | $D_4$ | $D_3$ | $D_2$ | $D_1$ | $D_0$ |
| $G_5$ | $G_4$ | $G_3$ | $G_2$ | $G_1$ | $G_0$ | $D_9$ | $D_8$ |
| $K12_3$ | $K12_2$ | $K12_1$ | $K12_0$ | $G_9$ | $G_8$ | $G_7$ | $G_6$ |
| $K11_1$ | $K11_0$ | $K12_9$ | $K12_8$ | $K12_7$ | $K12_6$ | $K12_5$ | $K12_4$ |
| $K11_9$ | $K11_8$ | $K11_7$ | $K11_6$ | $K11_5$ | $K11_4$ | $K11_3$ | $K11_2$ |
| $K10_7$ | $K10_6$ | $K10_5$ | $K10_4$ | $K10_3$ | $K10_2$ | $K10_1$ | $K10_0$ |
| $K9_5$ | $K9_4$ | $K9_3$ | $K9_2$ | $K9_1$ | $K9_0$ | $K10_9$ | $K10_8$ |
| $K8_3$ | $K8_2$ | $K8_1$ | $K8_0$ | $K9_9$ | $K9_8$ | $K9_7$ | $K9_6$ |
| $K7_1$ | $K7_0$ | $K8_9$ | $K8_8$ | $K8_7$ | $K8_6$ | $K8_5$ | $K8_4$ |
| $K7_9$ | $K7_8$ | $K7_7$ | $K7_6$ | $K7_5$ | $K7_4$ | $K7_3$ | $K7_2$ |
| $K6_7$ | $K6_6$ | $K6_5$ | $K6_4$ | $K6_3$ | $K6_2$ | $K6_1$ | $K6_0$ |
| $K5_5$ | $K5_4$ | $K5_3$ | $K5_2$ | $K5_1$ | $K5_0$ | $K6_9$ | $K6_8$ |
| $K4_3$ | $K4_2$ | $K4_1$ | $K4_0$ | $K5_9$ | $K5_8$ | $K5_7$ | $K5_6$ |
| $K3_1$ | $K3_0$ | $K4_9$ | $K4_8$ | $K4_7$ | $K4_6$ | $K4_5$ | $K4_4$ |
| $K3_9$ | $K3_8$ | $K3_7$ | $K3_6$ | $K3_5$ | $K3_4$ | $K3_3$ | $K3_2$ |
| $K2_7$ | $K2_6$ | $K2_5$ | $K2_4$ | $K2_3$ | $K2_2$ | $K2_1$ | $K2_0$ |
| $K1_5$ | $K1_4$ | $K1_3$ | $K1_2$ | $K1_1$ | $K1_0$ | $K2_9$ | $K2_8$ |
| $B_3$ | $B_2$ | $B_1$ | $B_0$ | $K1_9$ | $K1_8$ | $K1_7$ | $K1_6$ |
| $T_1$ | $T_0$ | $B_9$ | $B_8$ | $B_7$ | $B_6$ | $B_5$ | $B_4$ |
| X | X | $T_7$ | $T_6$ | $T_5$ | $T_4$ | $T_3$ | $T_2$ |

FIG. 3

DIGITAL SPEECH SYNTHESIZER

FIELD OF THE INVENTION

Our present invention relates to a digital synthesizer of sound waves for electronically producing artificial speech.

BACKGROUND OF THE INVENTION

In the field of telecommunications, the synthesis of speech is of particular interest. It permits people unskilled in computer technology to receive so-called canned messages, e.g. by telephone, without the necessity of employing full-time human operators or of using costly subscriber terminals. Such messages may inform a calling subscriber of congestion at an exchange, of the cost and duration of a call, and of a changed directory number.

In commonly owned U.S. Pat. No. 4,319,084, in the names of Paolo Lucchini et al, there has been disclosed a multichannel digital speech synthesizer designed to simulate the human voice as closely as possible. The patent also mentions several prior publications relating to speech analysis.

As further disclosed in that prior patent, a programmed message source such as a computer stores sets of processing parameters which can be transmitted in a predetermined sequence to a signal generator for commanding the emission of excitation pulses of varying amplitudes and polarities to a lattice filter; these parameters represent coded information relating to frequency distribution, volume and duration of speech elements such as diphones, i.e. phoneme pairs. Several identical input modules are inserted in parallel between the computer, on the one hand, and the signal generator and the filter, on the other hand, and are associated with respective output channels which carry speech samples produced by the filter after they have been converted from digital to analog form. A validity-interval counter and a sound-interval counter in each input module are presettable by the computer through the intermediary of a pair of alternately written and read buffer memories. The sound-interval counter measures the length of an operating period of a periodic signal, representing voiced sound, or an aperiodic (pseudorandom) signal, representing unvoiced sound, available from respective read-only memories in the signal generator; the validity-interval counter controls the switchover between the reading and writing phases of the two buffer memories. A further memory in each input module temporarily stores weighting coefficients and sound-intensity data obtained under the control of the sound-interval counter from whichever buffer memory is enabled for reading. All the elements of the synthesizer are controlled by a common time base. The operation of the synthesizer is based upon the presumption that the various filter coefficients, representing the effects of reflection between different cavities of an acoustic tube designed as a model of the human vocal tract, can be considered constant during short time intervals on the order of 10 ms. These filter coefficients are updated only at the beginning of an oscillatory cycle of a voiced-sound interval whose pitch is determined by the setting of the sound-interval counter.

OBJECTS OF THE INVENTION

An object of our present invention is to provide a speech synthesizer of the general type disclosed in the aforementioned U.S. Pat. No. 4,319,084 which can be integrated on a single chip, preferably with other assemblies of the same character, all associated with a common controller to provide a multichannel synthesizing system in which the number of channels is limited only by the operating speeds of the controller and of an associated data-receiving logic network.

Another object of our invention is to provide means in such a synthesizer enabling the start of its operation to be correlated with the operations of other devices, e.g. in a pulse-code-modulated (PCM) telephone system in which synthesized speech samples must be made available in time slots assigned to respective communication channels. It is also desirable, in such a system, to provide each synthesizer in addition to its analog output with a serial digital output facilitating logarithmic compression into, say, 8-bit words or bytes for PCM transmission over trunk lines; the emitted analog signals would then be carried only on local lines.

A further object of our invention is to provide a layout enabling the testing of the principal components of the synthesizer, or of a prototype thereof, in a trial run or in a production run for the detection of possible malfunctions.

SUMMARY OF THE INVENTION

A speech synthesizer according to our invention, connected via bidirectional external bus to an outside source of data words—such as a microprocessor—utilizable in the generation of digital speech samples, comprises first memory means such as the pair of buffer memories of U.S. Pat. No. 4,319,084 loadable by way of the external bus with data words constituting parameters relating to frequency distribution, volume and duration of speech elements. A bidirectional internal bus in connected to outputs of the first memory means and to loading inputs of first counting means, such as the sound-interval counter and the validity-interval counter of the prior patent, serving to control writing and reading of the first memory means while being presettable by data words read out from the first memory means in order to establish variable operating interval therefor. Waveform samples stored in second memory means, such as the periodic-waveform memory and the aperiodic-waveform memory of the prior patent, are readable onto the internal bus under the control of the first counting means. An operating memory connected to the internal bus receives additional parameters read out from the first memory means for supplying them to a synthesis filter for utilization in the processing of waveform samples read out from the second memory means to generate outgoing speech samples, the filter being provided with two-way connections to the internal bus which may include an ancillary bus and a buffer enabling communication between these two buses. The outgoing speech signals generated by the filter are emitted via the internal bus by output means preferably including a shift register which sends them out in digital form. Normal operation of the synthesis filter as well as the execution of a checking procedure, based on test words emitted by the microprocessor or other source on the external bus, is enabled by two sets of instructions stored in third memory means advantageously including a microinstruction memory, an associated address memory and a repetition memory. A choice between normal operation and checking procedure is possible by switchover means responsive to an external selection signal, the switchover means controlling second counting means for addressing the third memory means.

With the aforementioned microinstruction, address and repetition memories, the second counting means of the repetition memory and an address counter connected to address inputs of the microinstruction memory while being presettable by the contents of the address memory. These counters and memories are controlled by logic circuitry facilitating operation in the linear-prediction-coding (LPC) mode, that circuitry preferably including several programmed logic arrays also serving to control the buffer memories and the operating memory of the synthesizer. In response to repetition codes read out from the microinstruction memory. The logic circuitry facilitates recurrent readouts of preceding instruction groups.

BRIEF DESCRIPTION OF THE DRAWING

The above and other features of our invention will now be described in detail with reference to the accompanying drawing in which:

FIG. 3 is a table representing a block of coding parameters utilized in a system according to our invention.

SPECIFIC DESCRIPTION

Figure 1:
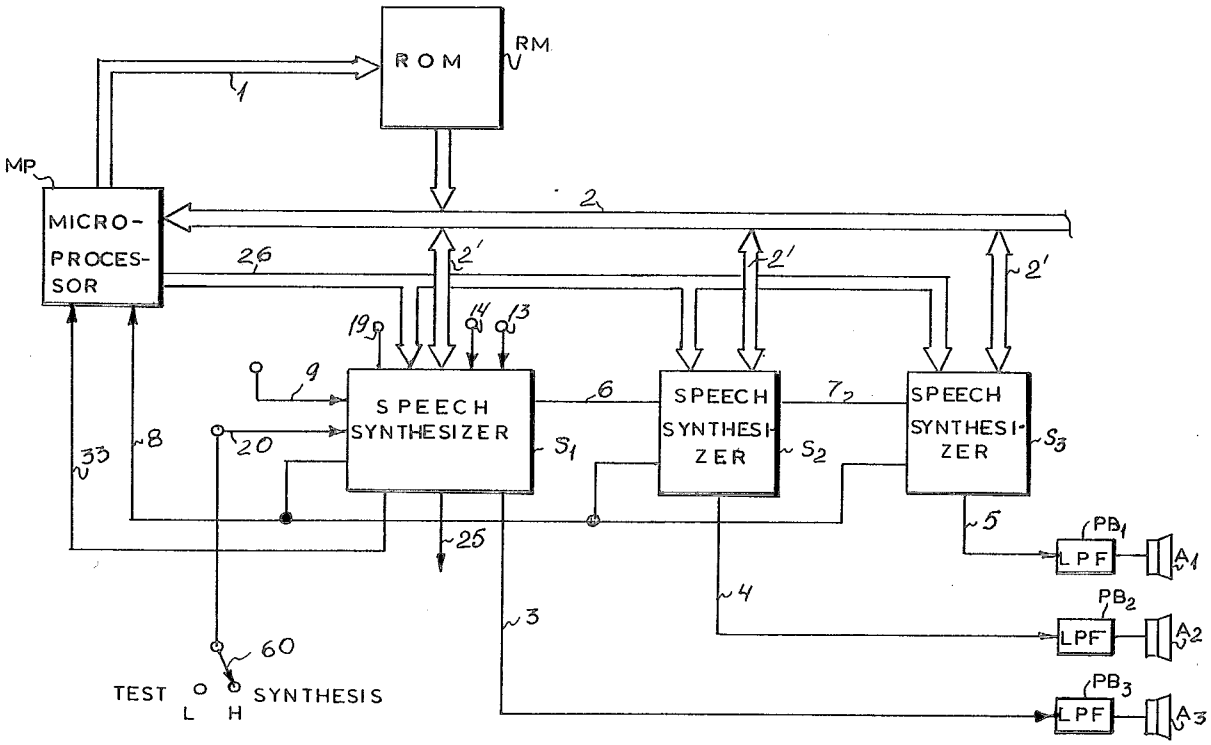
FIG. 1 is a block diagram showing several speech synthesizers according to our invention, controlled by a common microprocessor.

In FIG. 1 we have shown three mutually identical speech synthesizers $S_1$, $S_2$, $S_3$, using linear-prediction coding (LPC), which can be integrated on a common chip and are jointly controlled by a microprocessor MP with the aid of a read-only memory RM. This memory, addressable by microprocessor MP via a bus 1, contains the operating programs for the microprocessor, coding parameters for the voice signals (including codes for entire sentences, for individual words and for diphones) and tables for the decoding of the filter coefficients. The data read out from memory RM are transmitted by way of a bidirectional data bus 2 to the microprocessor retransmitting them over the same bus and branches 2' thereof, after suitable reconfiguration if necessary, to whichever synthesizer has requested a new set of parameters. Such reconfigurations may involve temporary storage and subdivision of overly long bit combinations; they may also include the performance of mathematical operations on combinations representing voiced sounds (see U.S. Pat. No. 4,319,084). These latter modifications may be in conformity with prosodic rules designed to improve the intonation of the synthetic speech produced.

A unidirectional service bus 26 carries operating instructions from microprocessor MP to the several synthesizers.

In operation, any synthesizer enabled by the microprocessor can emit on a lead 8 a request for new parameters. The three illustrated synthesizers (whose number could, of course, be varied) are shown interconnected in a preference chain assigning the highest priority to synthesizer $S_1$ which has an input lead 9 maintained at an invariable (e.g. high) logic level so as to be always in an enabled state. When synthesizer $S_1$ does not require new parameters, it generates a corresponding logic level on an output lead 6 extending to a corresponding enabling input of synthesizer $S_2$. Analogously, the latter enables via a lead 7 the synthesizer $S_3$ when being rendered operative via lead 6 while not requiring any new parameters for itself.

Analog output leads 3, 4 and 5 respectively extend from synthesizers $S_1$, $S_2$ and $S_3$ to associated low-pass filters $PB_1$, $PB_2$, $PB_3$ working into electroacoustic transducers $A_1$, $A_2$ and $A_3$.

As further shown for synthesizer $S_1$, which of course is also representative of the other synthesizers, there is an additional output lead 25 carrying a digital version of the speech signal present on lead 3. An input lead 20 is connected to a manual selector 60 which enables switchover between synthesis and test operations by changing from a high to a low logic level or vice versa. Three further binary inputs of the synthesizer $S_1$ include a lead 13 whose energization by an external source enables the start-up of operations, a lead 14 manually energizable to activate a logic network LR (FIG. 2) in order to clear various data stores of the synthesizer in an initialization phase, and a lead 19 for the selection of either of two sampling frequencies (8 or 10 KHz) in accordance with the logic level imposed by a nonillustrated external source. Finally, an outgoing lead 33 informs the microprocessor MP that synthesizer $S_1$ is ready to accept a new data word.

Details of the internal structure of synthesizer $S_1$ will be described herein after with reference to FIG. 2.

In FIG. 3 we have shown a data block consisting of 20 bytes transmitted in parallel by microprocessor MP to a requesting synthesizer via bus 2 and the associated branch 2'. Each byte consists of 8 bits whose significance progressively decreases from left to right, with individual weights indicated by subscripts 0 to 9 enabling these bits to be reorganized into 10-bit words whose boundaries are indicated by heavy vertical strokes. The symbols used in the table represent the aforementioned validity-interval duration D, synthesis-filter gain G and pitch period T. Symbols K1–K12 are filter coefficients whereas $\beta$ is a de-emphasis coefficient. Two unused bit positions at the lower left-hand end of the block are marked X.

When the sampling frequency selected by the logic level on lead 19 (FIG. 1) is 8 KHz, all bits K11 and K12 are 0. In the alternative case, i.e. when sampling is at 10 KHz, the values of these bits are determined by the analysis of the original speech signal. If that speech signal has not undergone a preemphasis treatment, no de-emphasis will be required and bits $\beta$ will be 0. All the bits T are 0 in the event of an unvoiced sound.

Figure 2:
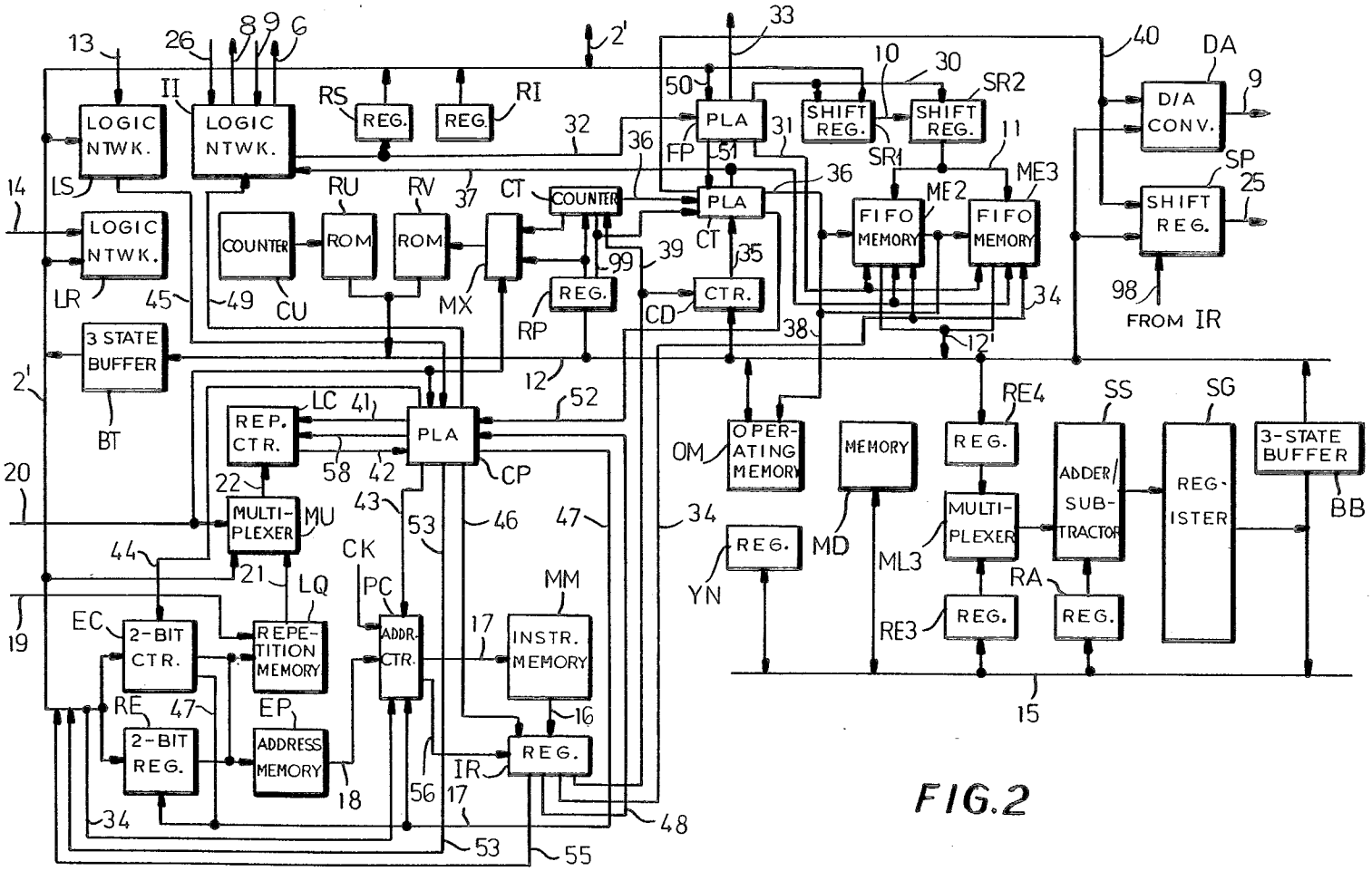
FIG. 2 is a more detailed block diagram of one of the synthesizers of FIG. 1.

In FIG. 2, single leads and buses or lead multiples have been indicated by thin and heavy lines, respectively, some connections used in the operations described below, have been omitted for clarity's sake. A shift register SR1, receiving in parallel the bits of incoming bytes from branch 2' of the external data bus 2 (FIG. 1), has a serial output 10 connected to another shift register SR2 which is provided with a serial input tied to the lead 10 and with a parallel output connected through a multiple 11 to a pair of read/write buffer memories ME2 and ME3 corresponding to the identically designated buffer memories of the prior U.S. Pat. No. 4,319,084. These memories, which are of the FIFO (first-in, first-out) type, alternate in their reading and writing phases under the control of counters CD and CT also having correspondingly designated counterparts in that prior patent. In the present instance, however, a finite-state unit TP is interposed between these counters and the associated memory inputs. Such a unit, well known in the art, is a programmed logic array (PLA) designed as a combinatory network with feedback loops introducing a delay of one clock cycle of the nonillustrated time base of the synthesizer; a register therein stores factive-state words.

Another PLA unit FP supplies stepping pulses for shift registers SR1, SR2 by way of lead 30 and has an output lead 31 terminating at loading inputs of buffer memories ME2 and ME3. Unit FP has an input connected via a lead 32 to a logic network II which detects a data-ready signal from microprocessor MP (FIG. 1) on service bus 26 whenever a new byte is present on external bus 2. Network II is also shown connected to the leads 6, 8 and 9 described with reference to FIG. 1. By keeping track of the number of shifts undergone by registers SR1 and SR2, unit FP knows whether or not register SR1 has been completely emptied in order to accommodate the new byte which until then is held frozen on bus 2. The actual loading of this byte into register SR1 occurs only upon the emission by unit FP of a signal on lead 33 informing the microprocessor that the synthesizer is ready for the transfer, giving rise to a request-acceptance signal on bus 26 detected by network II. Other instructions decoded by network II include read-out with commands as well as component identifications.

Reading commands are fed to memories ME2 and ME3 via a lead 34 from a register I forming part of a control circuit more fully described hereinafter. The memories ME2 and ME3 constitute a first memory means loadable from an outside source by way of the external bus and connected to the internal bus 12. The two memories work in parallel into a undirectional extension 12' of an internal bidirectional bus 12 which is connected to a presetting input of counter CD and, via a register RP, to a similar presetting input of counter CT. The counters CD and CT form first counting means provided with loading connections to the internal bus 12. These two counters are preloaded, as in U.S. Pat. No. 4,319,084, with data words respectively representing validity-interval duration D and pitch period T from which they count down to 0 at the selected sampling frequency of 8 or 10 KHz, At the end of its count of pulses on lead 59, component CD generates on an output lead 35 a signal retransmitted by unit TP to a lead 37 extending to switching inputs of memories ME2, ME3 and to logic network II. In response to this signal, network II emits a new-data request on lead 8 while the reading and writing phases of memories ME2 and ME3 are interchanged. A work read out at this time from one of these memories represents an updated value for the duration parameter D which is loaded into counter CD.

When counter CT has come down to 0, it emits a signal on a lead 36 to unit TP which thereupon energizes a lead 38 terminating at both buffer memories ME2, ME3 and at an operating memory OM that is in two-way communication with internal bus 12. If counter CD has previously gone to 0, as indicated by a signal on lead 35, the validity interval pertaining to the last count T has terminated so that a new pitch period T, loaded into register RP, is fed into counter CT. Otherwise, counter CT is reloaded with the previous value of T from register RP while a signal on lead 38 commands the discharge of the contents of the read-enabled memory ME2 or ME3 to bus 12 for the transfer of filter coefficients K1–K12, G, $\beta$ to operating memory OM and of a new pitch period T to register RP. From FIG. 3 it will be apparent that bytes pertaining to filter coefficients and to pitch periods are well separated so as to be stored in different sections of these memories for transfer to respective conductors of bus 12 connected to memory OM and register RP.

Counter CT further has an input connected via a lead 39 to another output of register IR which supplies stepping pulses to that counter in the event of a voiced sound, i.e. with $T \neq 0$. In the case $T=0$, register RP supplies an inhibiting signal via a lead 99 to CT; this signal instructs unit TP to command the readout of memory ME2 or ME3 in response to the end-of-count signal on lead 35.

Unit TP has a further output lead 40 extending in parallel to a digital/analog converter DA and to a shift register SP having outputs respectively connected to leads 3 and 25. Both components SP and DA are supplied in parallel with speech signals from bus 12 for respectively emitting them in analog and in serial digital form as already described with reference to FIG. 1. Both are disabled by the signal on lead 40 during an initialization phase while converter DA is also deactivated during operational tests.

The parallel outputs of register RP and corresponding outputs of counter CT are alternately connectable, via a multiplexer M, to address inputs of a read-only memory RV storing samples of periodic/excitation waveforms pertaining to voiced sounds, i.e. sequences of T pulses as described in U.S. Pat. No. 4,319,084. Thus, memory RV (corresponding to memory EP of the prior patent) emits a train of T pulses of which the first is positive and has an amplitude equal to $\sqrt{T-1}$ while the remaining pulses are negative and have amplitudes of $1/\sqrt{T-1}$. These pulses, which may be emitted at the frequency of 8 KHz, constitute an excitation signal having a zero mean value and unitary power as noted in the prior patent whereby variations in the d-c voltage level between successive sound elements are eliminated and the sound intensity or volume becomes precisely controllable in accordance with gain coefficient G. This is advantageous for the improvement of intonation.

Multiplexer M has its switching input tied to the lead 20 which in the case of a testing operation causes it to connect counter CT instead of register RP to the address inputs of memory RV.

Another read-only memory RU (corresponding to memory EC of the prior patent) is addressed by a counter CU to emit samples of a periodic excitation waveforms represented by pseudorandom sequences of positive and negative pulses of unit amplitude whose length should be such that no periodicity is noticeable, e.g. succession of $2^{10}$ pulses as stated in the prior patent; thus the memory RU is an aperiodic waveform memory of a second memory means formed by the memories RU, RV. The outputs of memories RV and RU are jointly connected to bus 12.

A register RI contains a word, constituting an interrupt vector, which is transmitted on cetain wires of bus 2 to the external microprocessor MP (FIG. 1) and is detected by the latter, upon a scanning of these wires, in response to a new-data request sent out over lead 8. The microprocessor loads this interrupt vector into register RI, by way of bus 2, during the initialization of the synthesizer to characterize same as entitled to such an interruption. The absence of this data word from register RI would require the synthesizer to operate in a so-called "polling" mode, i.e. to await being periodically addressed by the microprocessor in the course of its program before sending out a new-data request.

A state register RS, similarly connected to certain wires of bus 2, contains a byte including some bits which are used during a testing phase while others enable the microprocessor to ascertain whether or not converter DA and register SP (constituting the output means) are operative or are blocked by a signal on lead 40. A further bit of this byte is high when the synthesizer is to operate in the aforementioned "polling" mode.

A logic network LS has an input connected to lead 13 in order to receive the start-enabling signal mentioned in connection with FIG. 1. After initialization, which includes the clearing of various state registers in units FP and TP as well as of a further PLA unit CP by the logic network LR already referred to whose output connections have not been illustrated, network LS may receive via lead 13 an 8-KHz PCM-channel signal to start the synthesizer. If, however, no synchronization with external communication circuits is needed, network LS is permanently enabled as lead 13 will be held at a fixed potential. Networks LS and LR have data inputs connected to bus 2, 2' for a control of their operations by microprocessor MP.

A 3-state buffer register BT enables buses 12 and 2 to be interconnected via branch 2'. This allows the microprocessor to monitor the bytes emitted by memories RU and RV during a testing procedure.

Speech-signal synthesization is performed essentially in the manner described in prior U.S. Pat. No. 4,319,084. The corresponding filter includes two registers RE3, RE4 and a multiplier ML3 operating essentially like their homonymous counterparts in that prior patent. Other components of this synthesis filter are a register RA, an algebraic unit SS performing additions and subtractions on the contents of this register and of multiplier ML3, and an output register SG connected to unit SS. Register RE4 has parallel inputs connected to internal bus 12 whereas corresponding inputs of registers RE3 and RA are connected to an ancillary bidirectional bus 15 which can be placed in two-way communication with bus 12 through a 3-state buffer BB. Bus 15 is further tied to the output of register SG and, via two-way connections, to a memory MD and a register YN. Memory MD forms a storage means in the synthesis filter which stores the state variables calculated during the preceding sampling period while those of the current sampling period are loaded into register YN. These variables are thus available for processing essentially in the manner described for the filter TV of U.S. Pat. No. 4,319,084.

The connections supplying timing and enabling pulses to the components of the synthesis filter and to the buffers BT and BB have not been illustrated.

A third memory means including microinstruction memory MM of the read-only type forms part of a circuit arrangement which under normal operating conditions controls the synthesis filter and during a checking procedure facilitates the testing of that filter and of other major elements of the synthesizer. Memory MM is linked by a connection 16 with the instruction register IR storing for one cycle of a 4096-KHz clock the microinstructions read out from the memory. Besides the stage outputs connected to the leads 34 and 39 already referred to register IR has a stage output tied to a lead 48 which terminates at unit CP, a serial input connected via a lead 56 to an output of a counter PC, and a serial output connected via a lead 55 to one of the wires of bus 2, 2'. Counter PC has an output multiple 17 connected to address inputs of memory MM and an input multiple 18 extending from a read-only memory EP which carries several initial addresses of respective sets of microinstructions that are to be repeated a certain number of times. The number of such repetitions may assume several values stored in another read-only memory LQ having an output multiple 21 which is normally connected through a multiplexer MU to an input multiple 22 of a repetition counter LC. Memories EP and LQ are jointly addressable by a 2-bit counter EC and a 2-bit register RE which are loadable from respective wire pairs of bus 2, 2'.

Memory MM is divided into two sections respectively containing microinstructions for normal speech-synthesis operations and signals, pertaining to various testing operations described hereinafter. Repetition memory LQ is also divided into two sections selectable by the external binary signal on lead 19 which enables the changeover between sampling frequencies of 8 and 10 KHz. Thus, the number of repetitions of a given group of microinstructions can be varied with the sampling frequency. The connection between lead 19 and the slow clock stepping the counters CD, CT and CU has not been illustrated. Pulses CK from the fast clock of 4096 KHz, however, are shown applied to a stepping input of address counter PC which has another stepping input connected via a lead 43 to logic unit CP. This unit, furthermore, has an output lead 41 connected to a decrementing input of counter LC, an input lead 42 connected to an all-0 output of that counter, and another output lead 58 enabling the preloading of the same counter via connection 22. A further output lead 44 of unit CP ends at a stepping input of counter EC, whose task during normal operation is to set the number of steps which the filter must take to complete the synthesis of a speech sample. Additional output lead 46, 47 and 49 of unit CP respectively extend to a clearing input of register IR, to clearing inputs of counters EC, PC and register RE, and to logic network II.

During normal operation, with multiplexer MX connecting register RP to memory RV and with multiplexer MU interconnecting lines 21 and 22, register RE is empty. Counter PC, starting from 0, is progressively incremented by clock pulses CK while addressing that section of memory MM which pertains to speech synthesis. Repetition counter LC, preloaded with the contents of memory LQ upon the energization of lead 58 by unit CP, is continuously decremented by that unit via lead 41 until the completed countdown is signaled to the unit via lead 42. Unit CP then steps the counter EC to change the address of memory LQ whereupon counter LC is again preset by a loading command on lead 58. Register IR, which is held reset via lead 46 until a start-up command appears on the output lead 45 of network LS, energizes its stage outputs in accordance with the read-out microinstructions until lead 48 carries a signal indicating that a preceding group of microinstructions must be repeated. If counter LC is not yet at 0 at this point, unit CP enables the loading of counter PC with the address of the first microinstruction of the group to be repeated, that address being read out from memory EP by way of connection 18. The progressive decrementation of counter LC continues, as does the incrementation of counter PC. With the completion of each countdown of component LC, counter EC is advanced whereby a new address appears on connection 18; this address is then loaded into counter PC when a new repetition instruction read out from memory MM causes the energization of lead 48. When counter EC returns to its all-0 configuration, indicating the calculation of a synthesized speech sample, unit CP clears the counter PC by way of lead 47 so that the next synthesizing operation will commence at a count of 0. This sequence of operations is terminated when, under the control of the microprocessor MP of FIG. 1, network LS emits a corresponding command on its lead 45, as when the microprocessor determines that the synthesis of an entire speech message has been completed. Unit CP thereupon clears the register IR by way of lead 46 and awaits the arrival of the next start-up signal.

During the normal operation just described, the speech samples fed into register SG are transmitted by way of buffer BB and bus 12 and thence to output elements DA and SP. Shift register SP is stepped by pulses on a lead 98 emitted by instruction register IR. Each speech sample may be coded with 12 bits, for instance, which can then be compressed to an 8-bit word for transmission over a PCM channel.

The switchover means between normal and test operation includes the multiplexers MV and MX as well as line 20 and switch 60.

If multiplexers MX and MU have been switched for the initiation of a checking procedure, counter EC and register RE are preset by signals present on the wires of bus 2, 2′ to which they are connected. The loading of register RE to a nonzero value calls forth a different set of addresses stored in memory EP which pertain to the testing section of memory MM. Unit CP, informed of the switchover by way of an extension of lead 20, causes the loading of counter PC with the address then present on connection 18 while an initial configuration delivered by certain wires of bus 2, 2′ to multiplexer MU presets the counter LC. The addresses fed to memory LQ are correspondingly modified.

The counters LC and PC thus constitute second counting means controlled by the aforementioned switchover means MV, MX, etc. for addressing the third memory means MM.

The ensuing operations are analogous to those described above, with or without repetitions, except that counter EC is not stepped by pulses on lead 44. Instead, when counter LC returns to 0, unit CP clears the counters EC and PC along with register RE by way of lead 47 and energizes its output lead 49 to inform logic network II that a testing operation has terminated. This information is forwarded to the microprocessor by way of lead 8.

With the choice of suitable instruction addresses of memory MM, the microprocessor is thus able to command the execution of various test microprograms whose results may be monitored at the output 25 of shift register SP.

A lead 54 extending from a further wire of bus 2, 2′ enables the serial loading of address counter PC in order to read out any microinstruction stored in memory MM. After transfer to register IR, the selected instruction is serially read out to the bus by way of lead 55. In this way, the correctness of all the test and synthesis microprograms contained in memory MM can be verified.

The contents of address memory EP can also be tested in a similar manner. With suitable presetting of counter EC and register RE, a selected address code emitted on connection 18 and loaded into counter PC is serially read out by way of lead 56, register IR and lead 55. In like manner, a binary configuration entered directly in counter PC via lead 54 can be read out without intervention of memory MM.

The three PLA units FP, TP and CP, operating in the LPC mode, can also be tested. For this purpose their internal registers are interconnectable—with the aid of nonillustrated switches controlled by extensions of lead 20—in a cascade including conductors 50, 51, 52 and 53. Conductor 50 originates at one wire of bus 2, 2′ while conductor 53 terminates at another wire of that bus. Test words can be sent through this cascade in either direction to monitor the correctness of future-state words calculated by these units.

For the detection of possible malfunctions of buffer memories ME2 and ME3, the microprocessor loads them with suitable binary configurations and observes them on output lead 25 of shift register SP upon selection of an appropriate test microprogram contained in memory MM. Thereafter, other configurations fed into these buffer memories can be transferred to operating memory OM and to filter memory MD (the latter by way of buffer BB) whose contents can then be consecutively read with the aid of further stored microprograms. Multiplier ML3 and algebraic unit SS can be tested by a microprogram which loads registers RE3, RE4 and RA from memory ME2 or ME3, the result of their arithmetic operations (multiplication on component ML3, addition or subtraction in unit SS) being then forwarded via buffer BB to shift register SP.

Microprocessor MP may also select waveform memory RV or RU for testing. With incrementation of the associated address counter CT or CU by a suitable microprogram, the entire contents of the selected waveform memory may be successively read out via bus 12 and buffer BT to bus 2, 2′.

We claim:

1. A digital speech synthesizer connected via a bidirectional external bus to an outside source of data words utilizable in the generation of digital speech samples, said synthesizer comprising:

a bidirectional internal bus;

first memory means loadable from said outside source by way of said external bus with data words constituting parameters relating to frequency distribution, volume and duration of speech elements, said first memory means having output connections to said internal bus;

first counting means provided with loading connections to said internal bus for controlling writing and reading of said first memory means, said first counting means being presettable by data words read out from said first memory means for the establishment of variable operating intervals therefor;

second memory means storing waveform samples readable onto said internal bus under the control of said first counting means;

an operating memory connected to said internal bus for receiving additional parameters read out from said first memory means;

a synthesis filter with two-way connections to said internal bus for processing waveform samples read out from said second memory means and additional parameters stored in said operating memory to generate outgoing digital speech samples;

output means connected to said internal bus for emitting the outgoing speech signals generated by said synthesis filter;

third memory means storing two sets of instructions respectively enabling normal operation of said synthesis filter in response to data words loaded into said first memory means and execution of a checking procedure based on test words emitted by said outside source on said external bus;

switchover means responsive to an external selection signal for choosing between said two sets of instructions; and second counting means controlled by said switchover means for addressing said third memory means.

2. A speech synthesizer as defined in claim 1 wherein said two-way connections include an ancillary bus and a buffer enabling communication between said internal and ancillary buses, said synthesis filter including components connected in part to said internal bus and in part to said ancillary bus.

3. A speech synthesizer as defined in claim 2 wherein said synthesis filter is provided with storage means connected to said ancillary bus for temporarily retaining state variables calculated in a current and in a preceding sampling period.

4. A speech synthesizer as defined in claim 1 wherein said output means includes a shift register emitting said speech signals in digital form.

5. A speech synthesizer as defined in claim 1 wherein said first counting means comprises a validity-interval counter with loading inputs connected directly to said internal bus and a sound-interval counter with loading inputs connected to said internal bus through an interposed register for this temporary storage of updating parameters read out from said first memory means.

6. A speech synthesizer as defined in claim 5 wherein said second memory means comprises a periodic-waveform memory pertaining to voiced sounds and an aperiodic-waveform memory being adressable by a further counter, said switchover means including a multiplexer enabling said periodic-waveform memory to be addressed from said interposed register during said normal operation and from said sound-interval counter during said checking procedure.

7. A speech synthesizer as defined in claim 6 wherein said validity-interval counter, said sound-interval counter and said further counter are provided with external connection enabling their selective switching to a plurality of different sampling frequencies.

8. A speech synthesizer as defined in claim 1 wherein said third memory means includes a microinstruction memory, an associated address memory and a repetition memory, the instructions stored in said microinstruction memory including repetition codes specifying recurrent readouts of preceding groups of instructions, said second counting means including a repetition counter presettable by the contents of said repetition memory and an address counter which is presettable by the contents of said address memory and is connected to address inputs of said microinstruction memory, further comprising logic circuitry responsive to read-out instructions and programmed to control the loading of said address counter and a progressive decrementation of said repetition counter for causing said recurrent readouts to be executed.

9. A speech synthesizer as defined in claim 8, further comprising input means connected to said external bus and to a source of external enabling signals for commanding said logic circuitry to start and stop the readout of instructions from said microinstruction memory.

10. A speech synthesizer as defined in claim 8 wherein said switchover means includes a multiplexer enabling the presetting of said repetition counter from the contents of said repetition memory during said normal operation and from test words on said external bus during said checking procedure.

11. A speech synthesizer as defined in claim 8 wherein said address memory and said repetition memory are loadable by test words from said external bus during said checking procedure.

12. A speech synthesizer as defined in claim 8 wherein said microinstruction memory has parallel outputs connected to an instruction register provided with a plurality of outputs including a series output connected to a wrie of said external bus.

13. A speech synthesizer as defined in claim 12 wherein said instruction register is further provided with a series input connected to a series output of said address counter, another wire of said external bus being connected to a series input of said address counter for enabling a preloading thereof and a serial readout of the count thereof by way of said instruction register and said wires of said external bus.

14. A speech synthesizer as defined in claim 8 wherein said logic circuitry includes a plurality of programmed logic arrays for the control of said first memory means, said operating memory and said third memory means, said logic arrays being interconnectable in said checking procedure in a cascade between two wires of said external bus.

15. A speech synthesizer as defined in claim 1, further comprising buffer means enabling interconnection of said internal bus and said external bus for a readout of the contents of said second memory means during said checking procedure.

* * * * *